US008915167B2

(12) United States Patent
Ratajac

(10) Patent No.: US 8,915,167 B2
(45) Date of Patent: Dec. 23, 2014

(54) CORK SCREW

(76) Inventor: Aleksandar Ratajac, San Diego, CA (US)

( * ) Notice: Subject to any disclaimer, the term of this patent is extended or adjusted under 35 U.S.C. 154(b) by 189 days.

(21) Appl. No.: 13/315,280

(22) Filed: Dec. 8, 2011

(65) Prior Publication Data

US 2012/0204683 A1 Aug. 16, 2012

Related U.S. Application Data

(60) Provisional application No. 61/441,578, filed on Feb. 10, 2011.

(51) Int. Cl.
*B67B 7/04* (2006.01)
*B67B 1/04* (2006.01)

(52) U.S. Cl.
CPC ..... *B67B 7/0441* (2013.01); *B67B 1/045* (2013.01)
USPC ..... 81/3.29; 81/3.45; 81/3.47

(58) Field of Classification Search
CPC ..... B67B 7/04; B67B 7/0417; B67B 7/0423; B67B 7/0429; B67B 7/0441; B67B 7/0447; B67B 7/0411; B67B 7/12; B67B 7/14; B67B 7/063; B67B 7/44; B67B 1/045; B65B 43/38
USPC ..... 81/3.29, 3.45, 3.48, 3.49, 3.36, 3.37, 81/3.09, 3.47
See application file for complete search history.

(56) References Cited

U.S. PATENT DOCUMENTS 276,804 A * 5/1883 Green ..... 81/3.29
3,970,207 A 7/1976 Faulstich
3,984,022 A 10/1976 Babiol
4,213,215 A 7/1980 Hall
4,253,351 A 3/1981 Allen
4,276,789 A 7/1981 Allen
4,291,597 A 9/1981 Allen
4,429,444 A 2/1984 Allen
4,570,512 A 2/1986 Pracht
4,572,034 A 2/1986 Lee
4,574,663 A 3/1986 Delisle
4,637,283 A 1/1987 Bertram et al.
4,677,883 A 7/1987 Lee
D291,174 S 8/1987 Koziol
D294,449 S 3/1988 Kuhn
4,727,779 A 3/1988 Lee
4,800,784 A * 1/1989 Allen ..... 81/3.48
5,079,975 A * 1/1992 Spencer, Jr. ..... 81/3.29
5,086,675 A 2/1992 Leung et al.
5,134,906 A 8/1992 Sit
5,803,285 A 9/1998 Hirota (Continued)

*Primary Examiner* — Hadi Shakeri

(74) *Attorney, Agent, or Firm* — Timothy M. Brown, Esq.

(57) ABSTRACT

There is disclosed a cork screw made up of a spiral screw for driving into a cork to thereby remove the cork from a bottle. The spiral screw is attached to a handle for driving the spiral screw into the cork. The handle passes through a flange that, along with a cork screw stop, provides a countervailing force as the spiral screw is used to drive a cork back into a bottle. An upper stop, integral to the cork screw is included. The upper stop maintains the position of the cork screw relative to the bottle as the cork is being removed from the bottle using the spiral screw. A lower stop, integral to the cork screw is also included. This lower stop maintains the position of the cork screw relative to the bottle as the cork is being returned to the bottle using the spiral screw.

16 Claims, 9 Drawing Sheets

(56) References Cited

U.S. PATENT DOCUMENTS

| | | | |
|---|---|---|---|
| 5,862,720 | A | 1/1999 | McNellis |
| 5,884,789 | A | 3/1999 | Gardner |
| 5,934,160 | A | 8/1999 | Gibson |
| 6,029,836 | A | 2/2000 | Ligeras |
| D430,469 | S | 9/2000 | Thuma |
| 6,151,992 | A | 11/2000 | Larimer |
| 6,179,140 | B1 | 1/2001 | Gardner |
| 6,327,936 | B1 | 12/2001 | Eguren |
| 6,401,569 | B2 | 6/2002 | Usbeck |
| 6,530,295 | B1 | 3/2003 | Scott |
| 6,557,440 | B1 | 5/2003 | Presa Eguren |
| 6,622,595 | B1 | 9/2003 | Federighi |
| 6,820,519 | B2 | 11/2004 | Lefebvre |
| 6,823,760 | B1 | 11/2004 | Kilduff |
| 7,370,556 | B2 | 5/2008 | Sun |
| D571,629 | S | 6/2008 | Lown et al. |
| 7,398,709 | B2 | 7/2008 | Vitrac et al. |
| 7,775,140 | B2 | 8/2010 | Chan |
| 7,832,307 | B2 | 11/2010 | Ferrari |
| 2001/0013500 | A1 | 8/2001 | Gilley et al. |
| 2001/0039855 | A1 | 11/2001 | Usbeck |
| 2003/0126954 | A1 | 7/2003 | Lefebvre |
| 2003/0196985 | A1 | 10/2003 | Wheeler |
| 2005/0050643 | A1 | 3/2005 | Hefti et al. |
| 2005/0050998 | A1 | 3/2005 | Reynolds et al. |
| 2005/0199097 | A1 | 9/2005 | Soen et al. |
| 2005/0217434 | A1 | 10/2005 | Opolka |
| 2006/0112787 | A1 | 6/2006 | Cheung |
| 2006/0112788 | A1 | 6/2006 | Cheung |
| 2006/0185477 | A1 | 8/2006 | Sun |
| 2006/0233219 | A1 | 10/2006 | Harris |
| 2007/0051205 | A1 | 3/2007 | Farfalli et al. |
| 2007/0089570 | A1 | 4/2007 | Vitrac et al. |
| 2008/0022810 | A1 | 1/2008 | Panetti |
| 2008/0271573 | A1 | 11/2008 | Lown et al. |
| 2009/0241737 | A1 | 10/2009 | Chan |
| 2011/0100164 | A1* | 5/2011 | Mantilla et al. ..... 81/3.45 |

* cited by examiner

CORK SCREW

RELATED APPLICATION INFORMATION

This patent claims priority from provisional patent application No. 61/441,578 filed Feb. 10, 2011 and entitled "Cork Screw".

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to a cork screw for the removal and reinsertion of a cork into a corked bottle.

2. Description of the Related Art

Cork screws traditionally have been designed in such a way that they are suitable for the removal of corks from bottles. Typically, these bottles contain wines. The #9 cork is the standard diameter cork for wine bottles. Typical lengths are 1.5 inches, and 1.75 inches. Shorter corks (1.5 inches) are typically used for wines to be aged less than one year. To minimize the risk that the cork will dry out, longer corks (1.75 inches) are typically used for wines to be aged more than one year. Cork screws incorporate a screw portion, often with a perpendicular handle to aid in turning the screw and in removing the cork. The screw is then driven into the cork and the handle is used to remove the cork from the bottle. In some cork screws, a stop is provided to maintain the position of the cork screw relative to the lip of the bottle as the cork is removed and the screw is pulled.

Throughout this description, elements appearing in figures are assigned three-digit reference designators. An element not described in conjunction with a figure may be assumed to be the same element described in conjunction with a previous figure. An element that is not described in conjunction with a figure may be presumed to have the same characteristics and function as a previously-described element having a reference designator with the same least significant digits.

DETAILED DESCRIPTION

Description of Apparatus

Figure 1:
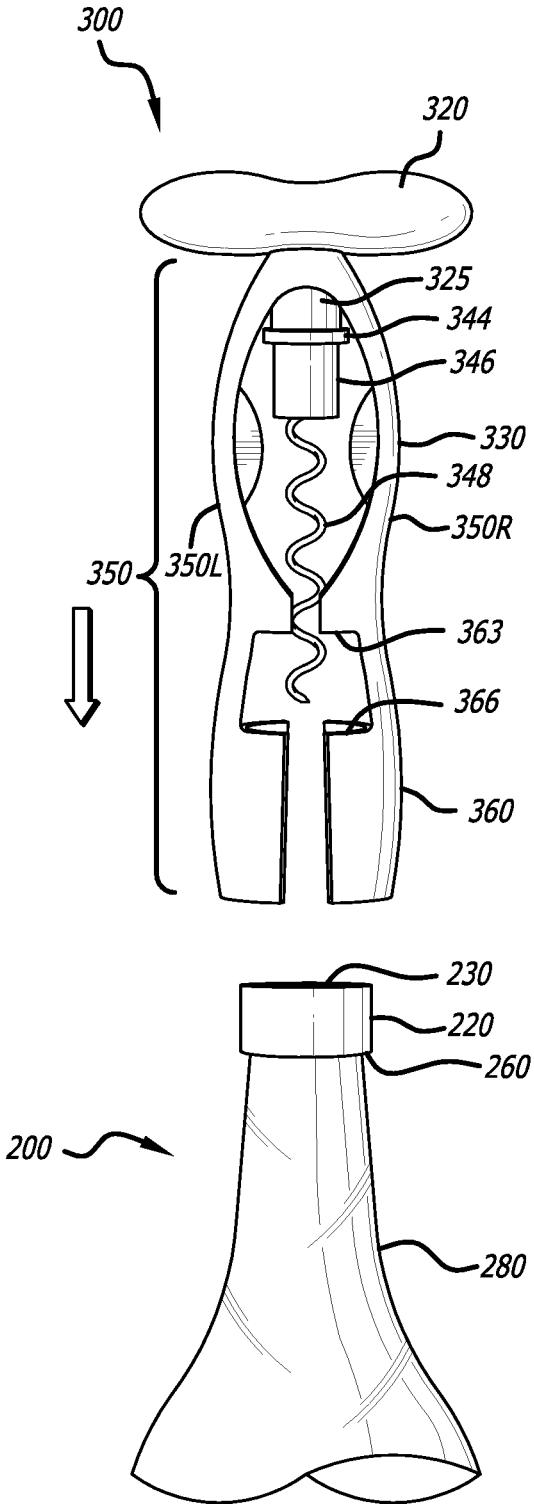
FIG. 1 shows a side view of a cork screw above a bottle.

FIG. 1 shows a cork screw 300 positioned above a bottle 200. The cork screw 300 may include a handle 320, a body 350, the body 350 made up of an upper portion 330 and a lower portion 360. The body 350 may also include two, divided arms 350R and 350L. The lower portion 360 of each arm 350L, 350R may include an upper stop 363 and a lower stop 366.

A portion of the handle 320 may extend through the upper portion 330 and a cork screw stop 325 and may be affixed to a cork screw base 346, which may be separated from the cork screw stop 325 by a flange 344. The cork screw stop 325 may be an integral part of the upper portion 330 of the cork screw 300. The cork screw base 346 and flange 344 may take the form of a flanged bushing.

The cork screw base 346 may be affixed to a spiral screw 348 interposed within the body 350. The spiral screw 348 may have a clockwise orientation (i.e., when looking down from the orientation shown). Alternatively the spiral screw 348 may have a counterclockwise orientation, and because other components and steps are tied to the orientation of the spiral screw 348, these other components and steps would be oriented respectively.

The bottle 200 may include a lip 220 with an upper edge 230 and a lower edge 260 in addition to a neck 280. A cork (not shown) may be disposed within the neck 280. The cork may be natural, artificial or a combination thereof.

All or a portion of the cork screw 300 may be made of a plastic or metal material. The cork screw 300 may incorporate an anti-slip material in portions such as the handle 320 or body 350. In particular, the internal-facing lower portion 360 may include anti-slip material for use in gripping the neck 280 of the bottle 200 as described below.

Figure 2:
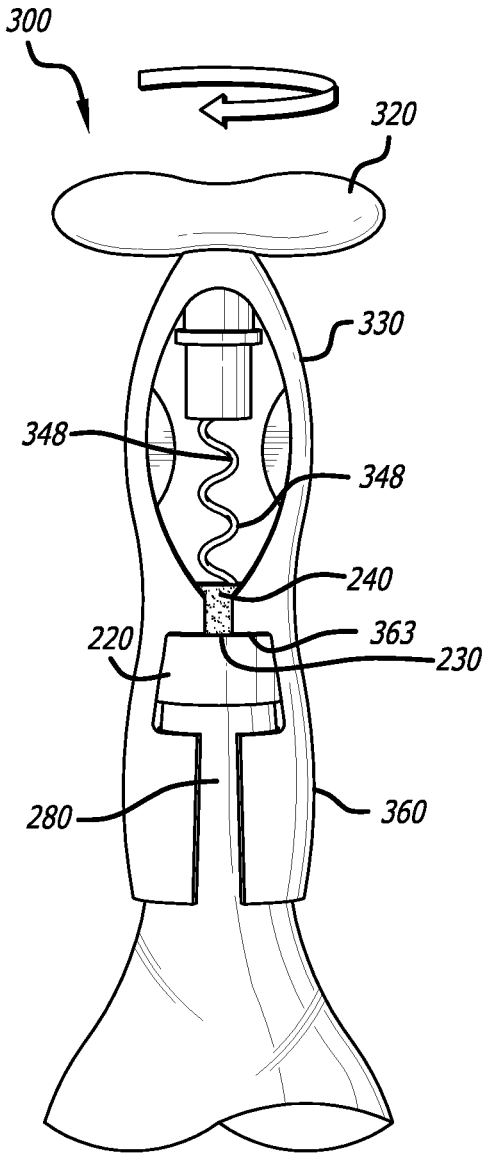
FIG. 2 shows a side view of the cork screw being used to remove a cork from the bottle.

FIG. 2 shows the cork screw 300 being used to remove a cork. The handle 320 of the cork screw 300 may be turned in a clockwise manner, i.e., looking down to the handle 320 as shown, to drive the spiral screw 348 into the cork 240. As the spiral screw 348 is driven into the cork 240, the handle 320 abuts the upper portion 330 to provide a countervailing resistance maintaining the position of the spiral screw 348 relative to the neck 280.

Simultaneously, the upper stop 363 abuts the upper edge 230 of the lip 220. This abutment provides counter-resistance so that the spiral screw 348 may be driven into the cork 240 as it is removed from the neck 280. In order to ensure that the upper stop 363 remains in an appropriate position to counteract the removal of the cork 240, the user may apply pressure against the lower portion 360 (e.g., by gripping and squeezing the lower portion 360) such that both sides of the lower portion 360 continue to abut the neck 280.

Figure 3:
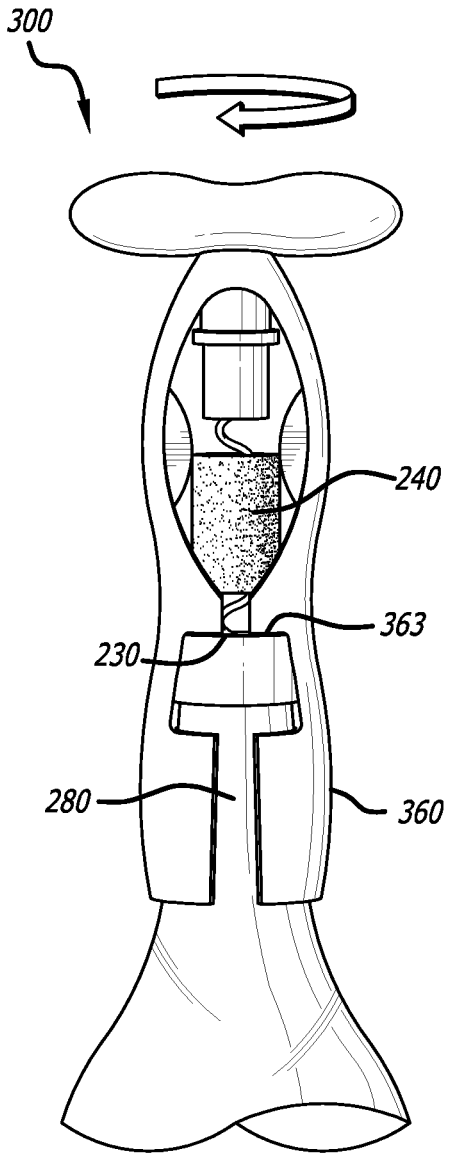
FIG. 3 shows a side view of the cork screw after removal of the cork.

FIG. 3 shows the cork screw 300 after removal of the cork 240. The cork 240 is shown fully-removed from the neck 280. The lower portion 360 continues to abut the neck 280. The upper stop 363 continues to abut the upper edge 230. Once the cork 240 is removed, the user may release the pressure applied to the lower portion 360 and remove the cork screw 300 from the neck 280.

Figure 4:
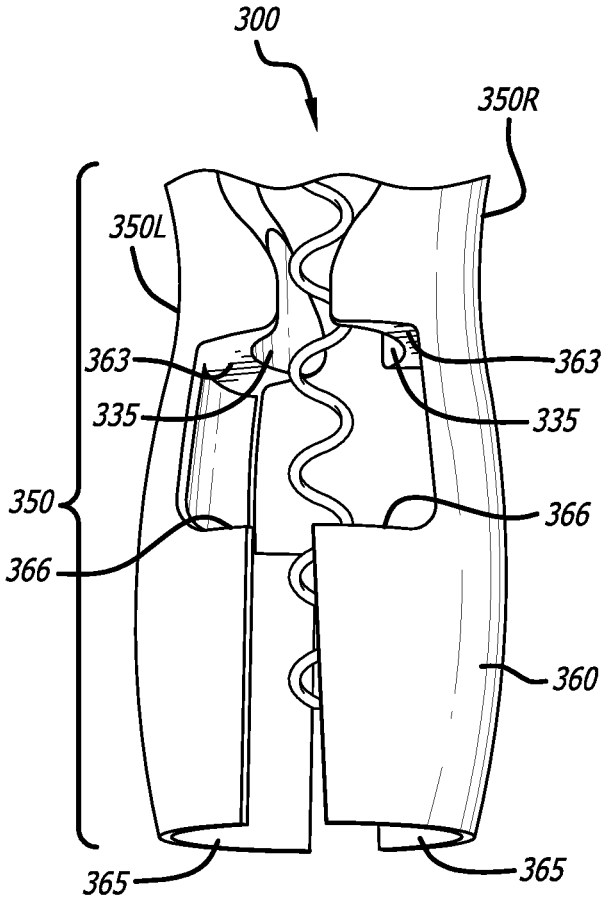
FIG. 4 is a partial perspective side view of the end of the cork screw.

FIG. 4 shows a partial perspective view of the cork screw 300. The lower portion 360 may include the upper stop 363 abutting two sides of a cork guide 335 formed on the respective arms 350L, 350R. The cork guide 335 acts to guide a cork (not shown) upward as the cork is removed from a bottle's neck (not shown), acting as a temporary "neck" into which the cork may move as it rises.

The lower stop 366 is also shown. The lower portion 360 of each arm 350L, 350R may include a respective portion of a neck clamp 365. Together, both sides of the neck clamp 365 may present a substantially cylindrical surface toward a bottle's neck. The neck clamp 365 may be operable to engage the neck in order to hold the neck in place so as to enable the cork screw 300 to maintain the resistance of the upper stop 363 and lower stop 366 as a cork is being removed or reinserted, respectively.

Figure 5:
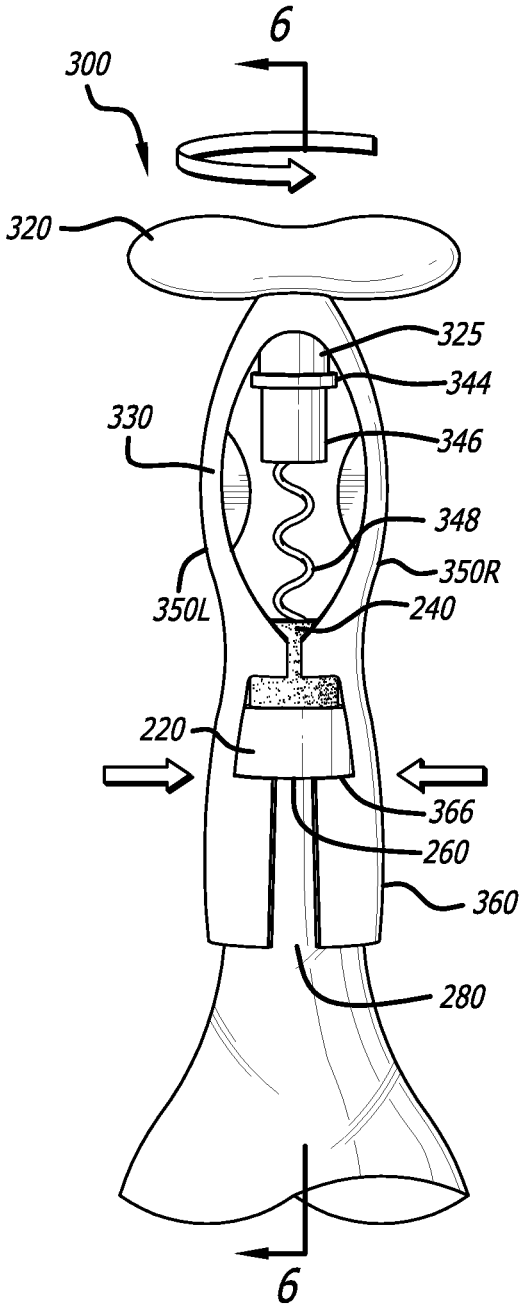
FIG. 5 shows a side view of the cork screw being used to reinsert the cork.

FIG. 5 shows the cork screw 300 being used to reinsert the cork 240. The handle 320 is rotated counter-clockwise to thereby turn the spiral screw 348 such that the cork 240 is pressed downward through the cork guide 335 (see FIG. 4) and into the neck 280. The flange 344 abuts the cork screw stop 325 and, along with the cork screw base 346 serves to maintain the position of the spiral screw 348 relative to the upper portion 330 of the cork screw 300 as the cork 240 is reinserted into the neck 280. The flange 344 provides a counter resistance from which the spiral screw 348 can be used to provide downward force on the cork 240 as it is reinserted into the neck 280.

As the cork 240 is driven into the neck 280, the lower stop 366 abuts the lower edge 260. This abutment enables the cork screw 300 to provide sufficient force and stability in order to drive the cork 240 into the neck 280. The user may compress the exterior of the lower portion 360 so as to force the two arms 350L, 350R to engage the neck 280 such that the lower stop 366 continues to abut the lower edge 260.

Without the lower stop 366 and lower edge 260 abutment, the cork screw 300 would be unable to force the cork 240 into the neck 280 without substantial application of downward force by the user to hold the cork screw 300 in place relative to the bottle 200. With the lower stop 366 abutting the lower edge 260, the user need only apply inward pressure such that the lower portion 360 of the arms 350L, 350R continue to engage the neck 280 which maintains the abutment of the lower stop 366 and lower edge 260.

Figure 6:
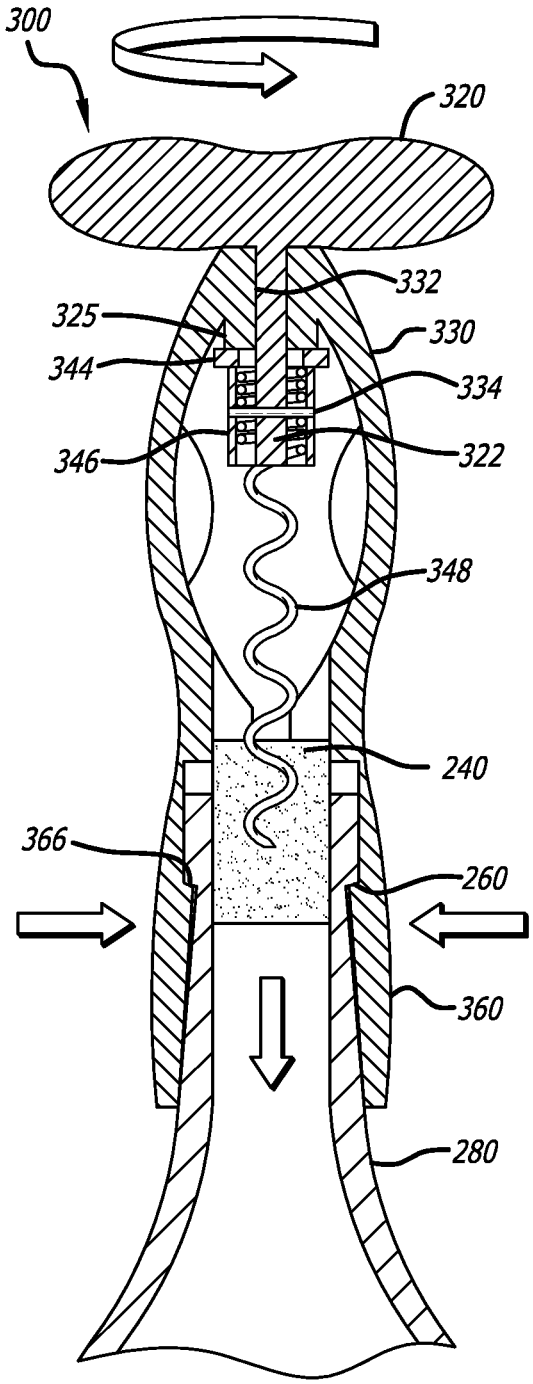
FIG. 6 shows a cross-sectional side view of the cork screw being used to reinsert the cork into the bottle.

Turning now to FIG. 6, there is shown a cross-section of the cork screw 300 being used to reinsert the cork 240. The spiral screw 348 is shown driving the cork 240 into the neck 280 of the bottle 200. An axle 322, connected to the handle 320 passes through a channel 332 in the upper portion 330 and the cork screw stop 325. The axle 332 may be integral to the handle 320 or a separate part, such as a short metal or reinforced plastic rod. The axle 332 passes through the cork screw stop 325 and through the flange 344 where it is affixed to the cork screw base 346 and, thereby, to the spiral screw 348.

A pin 334 may be used to affix the axle 322 to the cork screw base 346 and spiral screw 348. Screws, glue, rivets, welding or other bonding methods may be employed. The relative positions of the handle 320, axle 322, cork screw base 346 and spiral screw 348 are maintained such that tangential, circular force applied to the handle 320 in either direction is translated through the axle 322 and cork screw base 346 to the spiral screw 348.

As the cork 240 is driven back into the neck 280, the vertical (as shown in FIG. 6) position of the spiral screw 348 relative to the neck 280 is maintained because the flange 344 abuts the cork screw stop 325. The cork screw base 346 is unable to move upward (as shown in FIG. 6) past the flange 344 and the cork screw stop 325 as the cork 240 is driven into the neck 280. The flange 344 and cork screw stop 325 provide a countervailing force enabling the spiral screw 348 to remain stationary relative to the bottle as the cork 240 is driven back into the neck 280.

Similarly, the abutment of the lower stop 366 with the lower edge 260 is more clearly visible in this figure. The pressure being applied to the lower portion 360 of the cork screw 300 that maintains the engagement of the lower portion 360 of the arms 350L, 350R (FIG. 5) with the neck 280 is also visible in FIG. 6. This pressure maintains the abutment of the lower stop 366 and lower edge 260 as the cork 240 is driven into the neck 280. Once complete, the entire spiral screw 348 exits the cork 240 which is left inside the neck 280 of the bottle 200. The cork screw 300 may then be removed from the bottle 200, leaving the cork reinserted.

Figure 7:
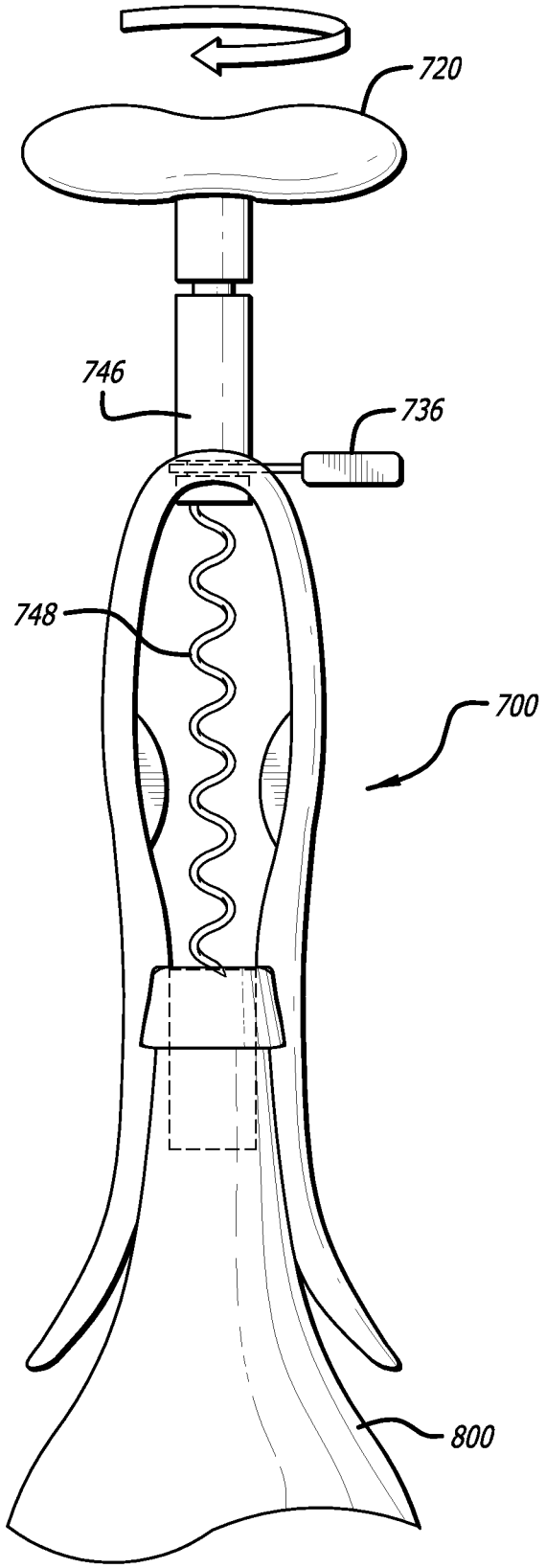
FIG. 7 shows a side view of another cork screw being used to remove a cork from a bottle.
Figure 8:
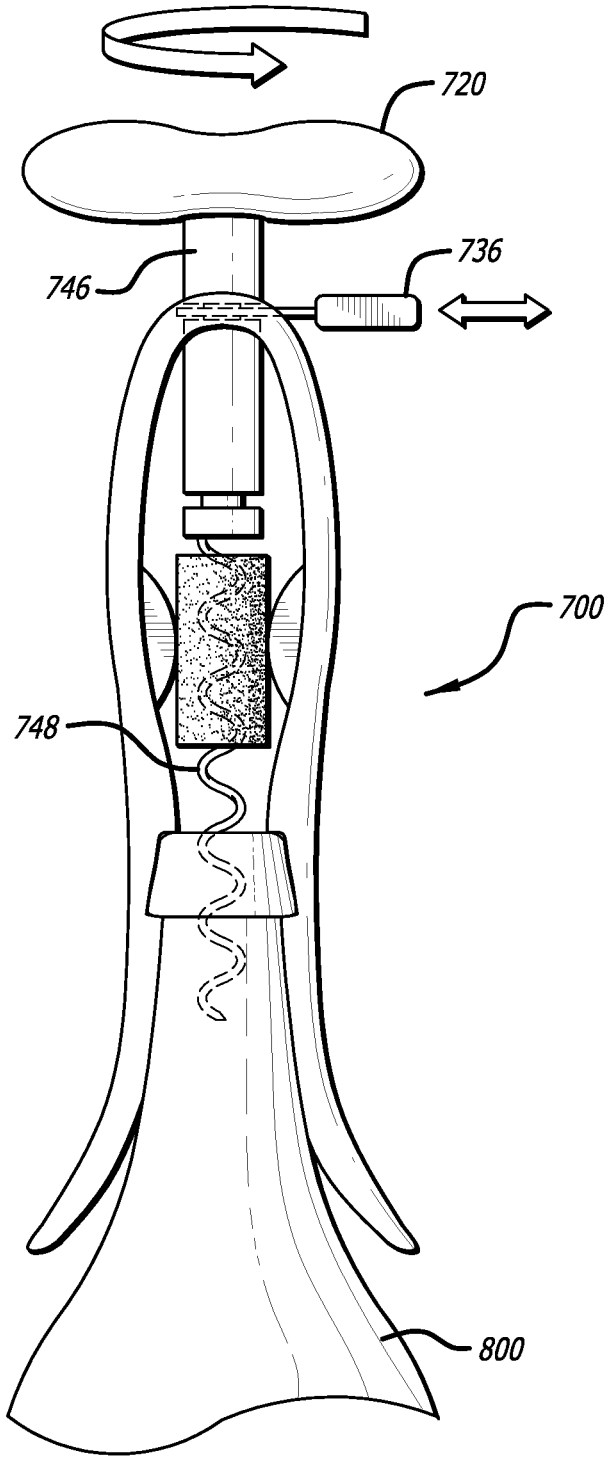
FIG. 8 shows a side view of the cork screw of FIG. 7 with the cork removed from the bottle.

In the cork screw 300, the handle 320 has a fixed position relative to the body 350. In typical cork screws, however, a handle is movable relative to the body. In particular as the cork is removed, the handle rises above the body. In the cork screw shown in FIGS. 7, 8 and 9, this "floating handle" functionality of typical cork screws is included in a cork screw 700 which is similar to the cork screw 300. Because of this similarity, descriptions of elements having identical configurations and functions will not be repeated. Likewise, reference numbers in FIGS. 7, 8 and 9 have the same final two digits as corresponding items in FIG. 1 through FIG. 6.

In the cork screw 700, there is no a cork screw stop or flange as in the cork screw 300. Furthermore, the cork screw base 746 is elongated, and extends between the handle 720 and the spiral screw 748. The cork screw base 746 may have a length at least the length of longest target corks. Since standard corks may be shorter or longer, the length of the upper portion 330 should be at least twice the length of the longest target corks to allow for the full translation of the cork screw base 746, plus the length of the cork i.e., about 3.5 inches.

Figure 9:
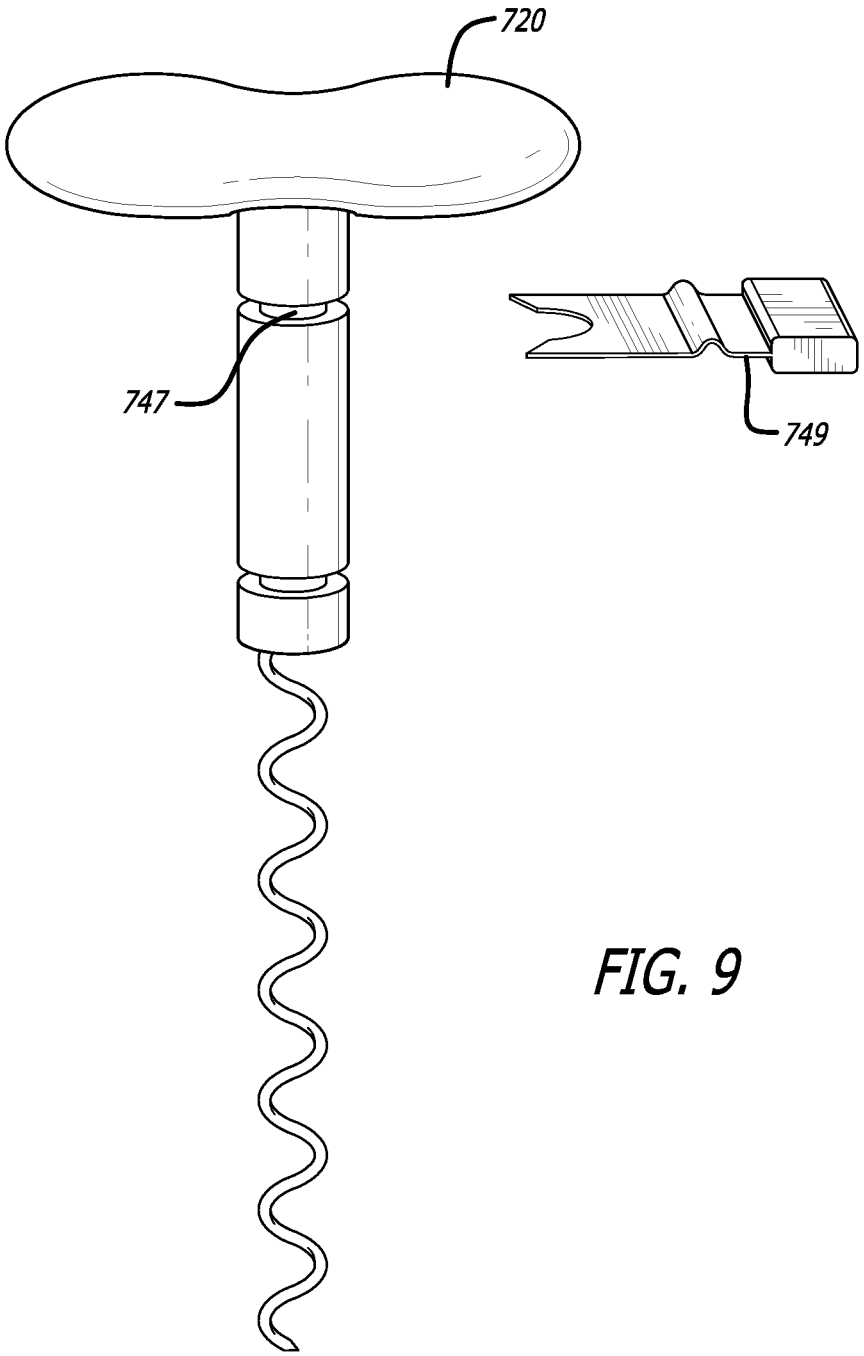
FIG. 9 is a partial side view of the cork screw.

To allow the cork screw to alternate between a standard removal mode and a special re-insertion mode, the cork screw 700 may include a lockout 736. The lockout 736 may be disposed on the upper portion 330. The lockout 736 may be a clip 749 as shown in FIG. 9, and mate to an indent 747 in the cork screw base 746. With the lockout 736 pulled away from the cork screw base 746, the handle 720 can move freely away and toward the body 350. With the handle 720 moved down to the base and the lockout 736 engaged, the handle 720 can be rotated as described above but cannot be pulled away from the body 350.

Thus, the cork screw 700 presents two modes. With the lockout 736 disengaged, there is a standard removal mode in which the cork screw 700 may be used like a typical cork screw and a cork removed. With the lockout engaged, there is a re-insertion mode in which the cork screw 700 may be used like the cork screw 300 and a cork inserted.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A cork screw comprising:

a divided body comprising two arms, wherein the divided body has a lower portion and an upper portion, wherein the arms are joined by a cork stop body positioned between the upper portion of the arms, and wherein the cork stop body comprises a planar surface and an aperture for receiving a spiral screw;

a spiral screw for driving into a cork to thereby remove the cork from a bottle having a neck, wherein the spiral screw traverses the cork stop body through the aperture and wherein the spiral screw comprises a flange that abuts the planar surface of the cork stop body to provide resistive force to the spiral screw as the cork is returned to the bottle using the cork screw;

a handle, attached to a top of the spiral screw, for driving the spiral screw into the cork;

an upper stop, integral to the arms, for maintaining the position of the cork screw relative to the bottle as the cork is being removed from the bottle using the spiral screw; and a lower stop, integral to the arms, for maintaining the position of the cork screw relative to the bottle as the cork is being returned to the bottle using the spiral screw.

2. The cork screw of claim 1 wherein the upper stop and the lower stop are substantially circular in cross-section.

3. The cork screw of claim 1 wherein the arms each include a portion of the lower stop such that when the arms are compressed around the neck of the bottle the lower stop engages a lip of the neck as a user operates the cork screw to reinsert the cork.

4. The cork screw of claim 3 wherein the lower portion of the arms incorporates anti-slip material on an internal surface abutting the neck.

5. The cork screw of claim 1 wherein a lower portion of the arms is substantially tubular such that it may substantially enclose the neck and, when compressed, engage the neck of the bottle.

6. The cork screw of claim 1 wherein an upper portion of the arms incorporates a substantially tubular guide such that as the cork is removed from the bottle using the spiral screw, the cork is substantially surrounded and guided out of the bottle by the guide.

7. The cork screw of claim 1 wherein an upper portion of the arms incorporates a substantially tubular guide such that as the cork is returned to the bottle using the spiral screw, the cork is substantially surrounded and guided into the bottle by the guide.

8. The cork screw of claim 1 wherein the arms further each include a portion of the upper stop such that when the divided body is compressed it closes the upper stop around the neck of the bottle to thereby cause the lip of the bottle to abut the upper stop as a user operates the cork screw to remove the cork.

9. The cork screw of claim 1, wherein the arms form a space for that is traversed by the cork stop body and the cork stop body comprises a planar surface that abuts the flange and provides resistive force to the spiral screw as the cork screw is used to return the cork to the bottle.

10. A cork screw comprising:

a spiral screw for driving into a cork to thereby remove the cork from a bottle having a neck, wherein the spiral screw comprises a flange;

a handle, attached to a top of the spiral screw, for driving the spiral screw into the cork;

a divided body, through which the spiral screw is interposed, made up of a first arm and a second arm;

a cork screw stop positioned between the first arm and the second arm, wherein the cork screw stop has an aperture and a planar bottom, wherein the spiral screw traverses the cork screw stop through the aperture and wherein the flange on the spiral screw abuts the planar bottom of the cork screw stop;

an upper stop, integral to the divided body, for maintaining the position of the cork screw relative to the bottle as the cork is being removed from the bottle using the spiral screw; and a lower stop, integral to the divided body, for maintaining the position of the cork screw relative to the bottle as the cork is being returned to the bottle using the spiral screw.

11. The cork screw of claim 10 wherein the upper stop is made up of a first and second upper stop portion, each integral to one of the first and second arms.

12. The cork screw of claim 10 wherein the lower stop is made up of a first and second lower stop portion, each integral to one of the first and second arms.

13. The cork screw of claim 10 further comprising a cork guide, made up of two cork guide portions, each integral to one of the first and second arms, for substantially surrounding and guiding the cork as it is being removed from the bottle using the spiral screw.

14. The cork screw of claim 10 further comprising a cork guide, made up of two cork guide portions, each integral to one of the first and second arms, for substantially surrounding and guiding the cork as it is being returned to the bottle using the spiral screw.

15. The cork screw of claim 10, wherein the planar bottom of the cork stop body is substantially perpendicular to the first arm and the second arm.

16. A cork screw comprising:

a spiral screw for driving into a cork to thereby remove the cork from a bottle, wherein the spiral screw comprises a flange;

a handle, attached to a top of the spiral screw by an elongated neck, for driving the spiral screw into the cork;

a divided body, through which the elongated neck passes and in which the spiral screw is interposed, made up of a first arm and a second arm which define a space between the first arm and the second arm;

a cork stop body that joins the first arm and the second arm and traverses the space, wherein the cork stop body comprises an aperture for receiving the spiral screw and a planar bottom that abuts the flange of the spiral screw as the cork screw is used to return the cork to the bottle;

an upper stop, integral to the divided body, for maintaining the position of the cork screw relative to the bottle as the cork is being removed from the bottle using the spiral screw; and a lower stop, integral to the divided body, for maintaining the position of the cork screw relative to the bottle as the cork is being returned to the bottle using the spiral screw.

* * * * *